US007063554B2

(12) United States Patent
Kuiken et al.

(10) Patent No.: US 7,063,554 B2
(45) Date of Patent: Jun. 20, 2006

(54) MODULAR CONNECTOR ANTI-SNAG RETROFIT

(75) Inventors: David Paul Kuiken, Round Rock, TX (US); Mark Daniel Rogalski, Leander, TX (US)

(73) Assignee: International Business Machines Corporation, Armonk, NY (US)

( * ) Notice: Subject to any disclaimer, the term of this patent is extended or adjusted under 35 U.S.C. 154(b) by 407 days.

(21) Appl. No.: 10/339,771

(22) Filed: Jan. 9, 2003

(65) Prior Publication Data

US 2004/0134061 A1 Jul. 15, 2004

(51) Int. Cl.
*H01R 13/627* (2006.01)

(52) U.S. Cl. ..... 439/352; 439/676; 439/344; 385/86

(58) Field of Classification Search ..... 439/352–354, 439/676, 344; 385/86
See application file for complete search history.

(56) References Cited

U.S. PATENT DOCUMENTS 5,600,885 A 2/1997 Schroepfer et al. ..... 29/883
5,685,796 A * 11/1997 Chen et al. ..... 475/320
6,254,418 B1 * 7/2001 Tharp et al. ..... 439/352
6,357,934 B1 * 3/2002 Driscoll et al. ..... 385/86

OTHER PUBLICATIONS

Terry R. Cobb *The High Density Standard for Premises Networks*, IEEE 802.5, Nov. 1998.

* cited by examiner

*Primary Examiner*—Truc Nguyen
(74) *Attorney, Agent, or Firm*—Volel Emile; Marilyn S. Dawkins

(57) ABSTRACT

A device to retrofit an existing modular connector having a flexible projecting connector tab that renders a cable to which the modular connector is connected susceptible to snagging is provided. The device is attached onto the connector and has a hollow interior, a bottom, two lateral sides, and a top. The top has a projecting tab. The projecting tab is set at an angle to allow the device tab to preclude objects from entering an opening formed by the connector tab and the connector and thus prevents the connector from snagging.

1 Claim, 4 Drawing Sheets

MODULAR CONNECTOR ANTI-SNAG RETROFIT

BACKGROUND OF THE INVENTION

1. Technical Field

The present invention is directed generally to electrical cables. More specifically, the present invention is directed to a device that may be used to prevent electrical cables with a modular connector fitted with a flexible tab from having a tendency to snag against objects such as wires, cables etc.

2. Description of Related Art

Electronic devices, such as computer components, sometimes are stored in electronics rack systems to conserve floor space. These computer components may include servers, computer systems, storage devices (i.e., disk drives, tape drives, and redundant array of independent or inexpensive disk (RAID) drives), and other electrical devices. The rack systems typically have a number of cables protruding in the rear. These cables include power cables as well as input and output cables that connect one component to another or to other systems housed within the same rack systems and/or elsewhere.

Most input and output cables are terminated with a connector, such as a registered jack (RJ) type modular connector (e.g., RJ-45 etc.), to connect the various components to each other. The RJ-type modular connectors have a flexible tab adapted to latch and unlatch the connector from another mating connector. The tab is attached to one end of the modular connector and projects outward from the point of attachment. Thus, there is a space or opening formed between the projected end of the tab and the connector. This renders the cable to which the modular connector is attached susceptible to snagging.

For example, the cables are usually run under raised floors, across floors, behind rack systems and furniture, above ceilings, in walls and other paths to interconnect the components. When, for any reason, a cable needs to be retrieved, it is often pulled from one end through the path it was installed. During the retrieval, another cable or any other item along the path may become lodged in the opening. When that occurs, the cable may-snag. If the user continues to pull on the cable while it is thus snagged, the tab may snap off and render the cable unusable.

Currently, connectors have been fitted with a rubber boot that is placed over the tab of the modular connectors to prevent objects from entering into the opening. One such fitted connector is disclosed in U.S. Pat. No. 5,600,885, issued to Richard C. Schroepfer on Feb. 11, 1997. However, the rubber boot can sometimes make it difficult for a user to depress the tab when unlatching the modular connector from a device. Consequently, users have sometimes taken the rubber boot off the tab to easily depress the tab. This action circumvents the purpose of the rubber boot, especially if the rubber boot is not placed back over the tab afterward.

Furthermore, there are a lot of cables in use today with modular connectors that are not fitted with the rubber boots. These cables have to be replaced in order to enjoy the benefit provided by the rubber boots. Replacing all these cables may be quite an expensive and time-consuming endeavor.

Consequently, what is needed is a retrofit device that may be used to prevent cables with modular connectors from snagging.

SUMMARY OF THE INVENTION

The present invention provides a device to retrofit an existing modular connector having a flexible projecting connector tab that renders a cable to which the modular connector is connected susceptible to snagging. The device has a hollow interior, a bottom, two lateral sides, and a top. The top has a projecting tab. The projecting tab is set at an angle to allow the device tab to preclude objects from entering an opening formed by the connector tab and the connector and thus prevents the connector from snagging.

The device is configured such that it can be attached onto an existing modular connector. Particularly, two protrusions at the bottom of the device, which mate with an elongated cavity at the bottom of an existing modular connector, are used to secure the device onto the connector. To attach the device onto the connector, the connector is slid into the hollow interior of the device until the two protrusions snap into the elongated cavity. The device may further be color-coded. This allows for easy identification of one cable from another when different colored devices are used with different cables.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIG. 1(*b*) depicts a lateral view of the prior art RJ-45 modular connector.

FIG. 1(*c*) depicts a bottom view of the prior art RJ-45 modular connector.

DETAILED DESCRIPTION OF THE PREFERRED EMBODIMENT

Figure 1A:
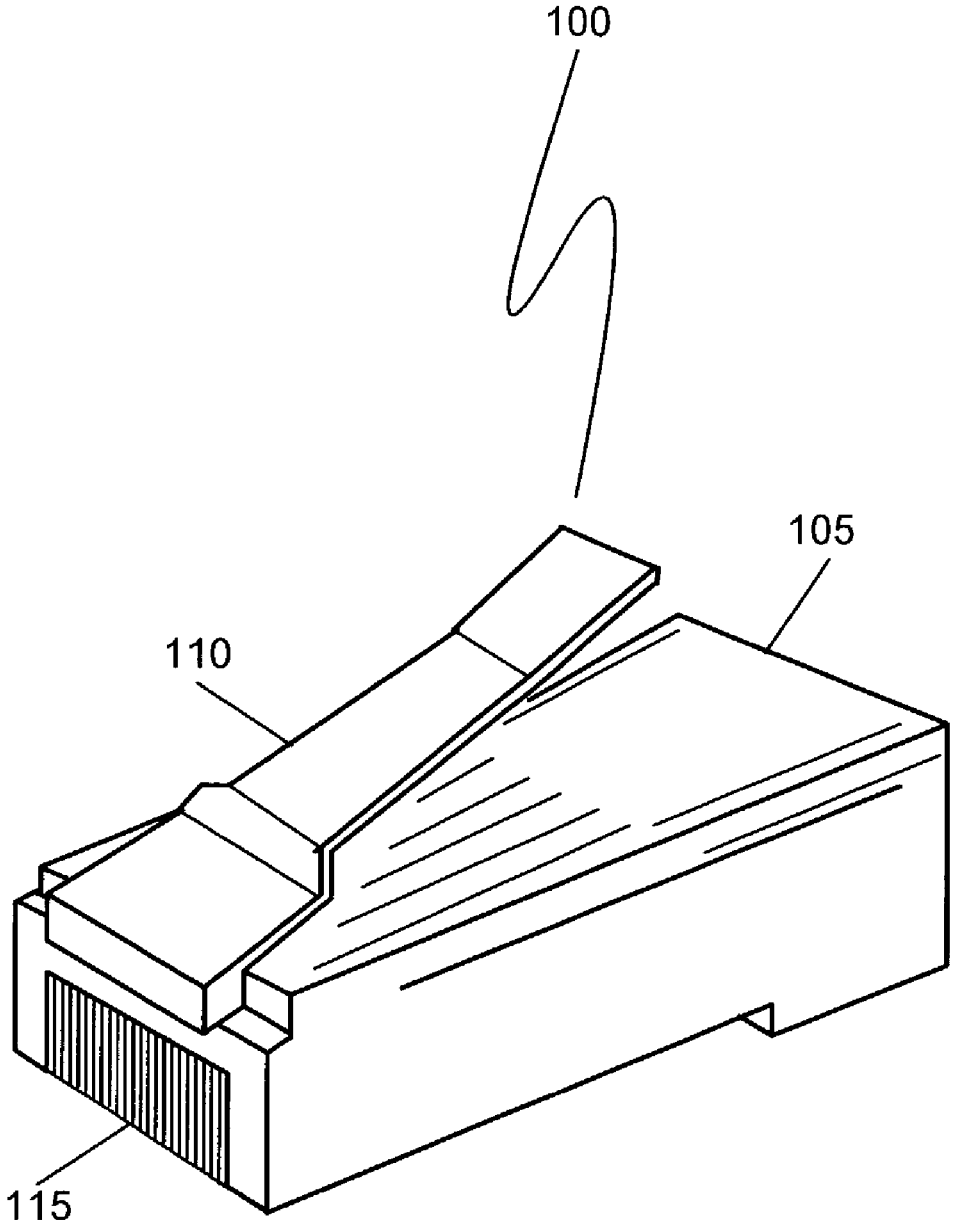
FIG. 1(a) (PRIOR ART)
FIG. 1(*a*) depicts an isometric view of a prior art RJ-45 modular connector.
Figure 1:
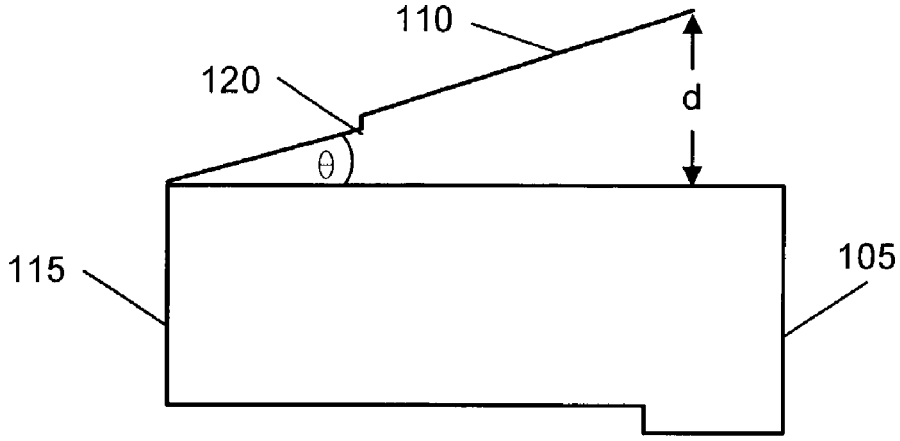
FIG. 1 (b) (PRIOR ART)
Figure 1C:
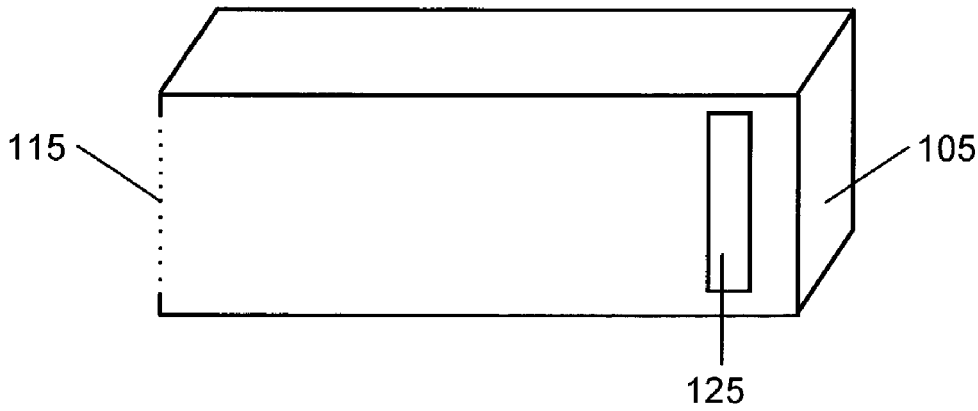
FIG. 1(c) (PRIOR ART)

Turning to the figures, wherein like numbers denote like parts throughout, FIG. 1(*a*) depicts an isometric view of an RJ-45 modular connector 100. The modular connector has an end 105 to which a cable (not shown) may be attached. The cable is typically terminated with another RJ-45 connector at its other end. The modular connector has an end 115, which contains a plurality of connector pins. The connector pins are used to transfer electrical and signal connections between any two electronic components to which the cable may be connected.

The RJ-45 modular connector 100 has a flexible tab 110 (i.e., a connector tab). The flexible connector tab 110 is attached to the modular connector at end 115 and forms an angle θ with the body of the connector (see FIG. 1(*b*)). The other end of the flexible connector tab 110 is not attached to the modular connector 100 and is at a distance d away from the connector. Thus, an opening "d" is formed between the flexible connector tab 110 and the connector 100.

As mentioned above, when for any reason a cable is being retrieved, it is usually pulled from one end through the path it was installed. During the retrieval, another cable or any other object along the retrieval path may enter into opening "d" and may become lodged therein. If the user continues to pull on the cable when that occurs, the tab may snap off and render the cable unusable. The present invention provides a device that may be used to inhibit objects from entering into the opening "d" and thus may prevent the cable from snagging when the cable is being retrieved.

Figure 2:
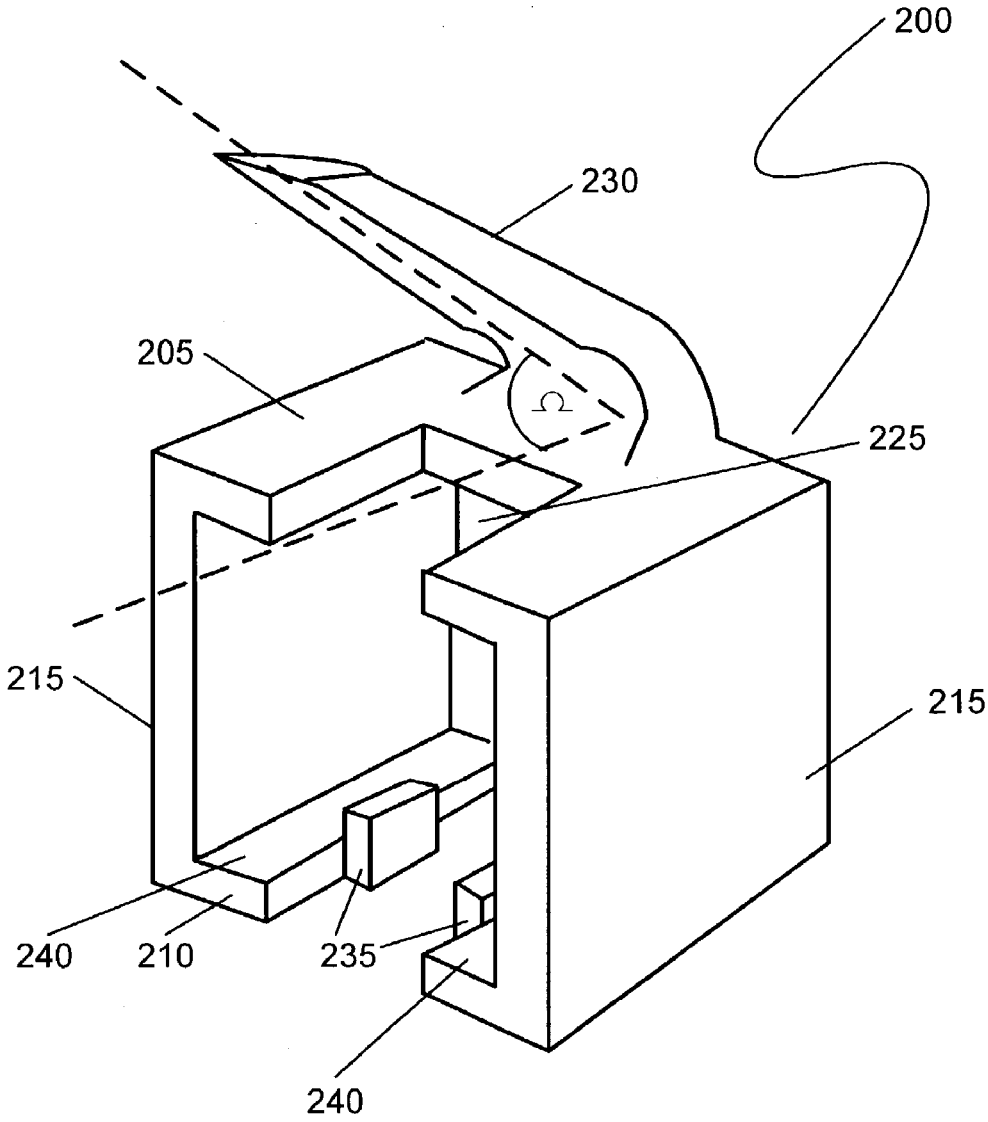
FIG. 2 depicts a schematic diagram of a casing that may be used to retrofit existing RJ-45 type modular connectors.
Figure 3:
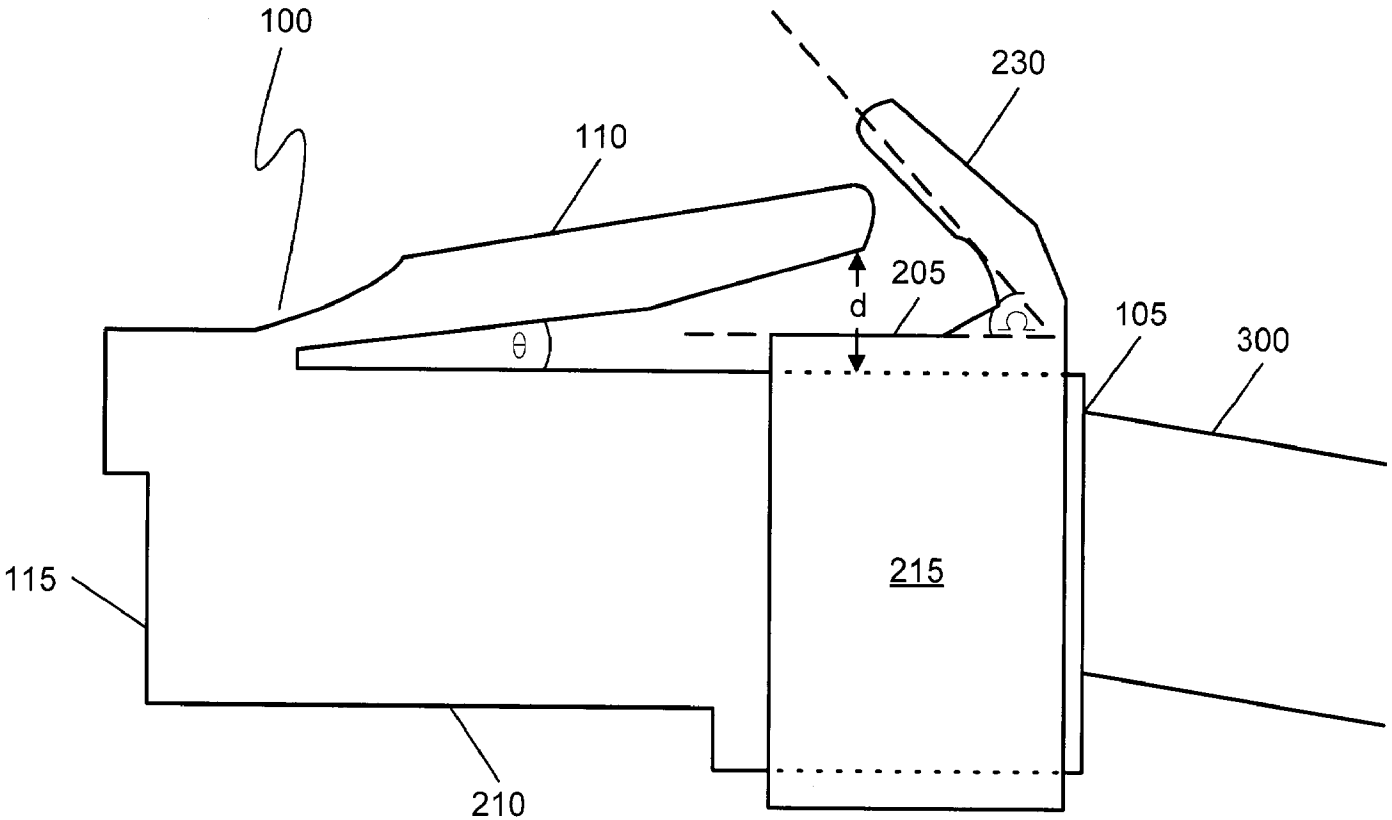
FIG. 3 depicts an RJ-45 type modular connector encased with the device of the present invention.

FIG. 2 depicts a schematic diagram of a casing 200 that may be used to implement the invention. Casing here is used to mean a device that has a hollow interior. The casing 200 has a bottom side 210, a top 205 and two lateral sides 215. The casing 200 is attached to the modular connector 100 as shown in FIG. 3. To facilitate the use of the casing 200 with the modular connector 100, the casing 200 is manufactured with a bottom side 210 having an expandable opening. The bottom side 210 has a flange 240 on either side. The flanges 240 each have a protrusion 235 that mates with a cavity at the bottom of the modular connector 100 in order to fasten the casing onto the connector. This cavity is shown as cavity 125 in FIG. 1(*c*).

The top 205 has a recess 225 and a device tab 230. The recess 225 is used to allow the connector tab 110 to be fully depressed when the modular connector is being unlatched from the electronic component to which it is connected. Fully depressed, in this case, is used to indicate that the connector tab 110 is deflected to such an extent that angle 0 becomes a zero degree angle.

The device tab 230 makes an angle Ω with the casing 200. Angle Ω of the casing is greater than angle θ of the connector. Consequently, when the casing 200 is attached onto the modular connector 100, the device tab 230 covers opening d, preventing objects from entering therein. Furthermore, the device tab 230 is also flexible and may also be fully depressed. Just as before, fully depressed is used to indicate that the device tab 230 is deflected down enough such that angle Ω becomes a zero degree angle. This allows a cable having a modular connector fitted with the casing of the invention to be pulled through small spaces.

Note that, when device tab 230 is depressed far enough, it may depress connector tab 110. Consequently, when unlatching the connector 100 from its mating connector (not shown), a user may do so by depressing device tab 230, which in turn will depress connector tab 110.

FIG. 3 depicts an RJ-45 modular connector fitted with the casing 200 of the present invention. The modular connector 100 is attached to a cable 300. The casing 200 of the present invention is attached at the end of the modular connector. As mentioned above, this configuration allows the device tab 230 to cover opening "d" to prevent a cable thus fitted from snagging.

Note that the casing 200 shown in FIG. 2 may be made of material such as plastic, metal (i.e., spring wire) etc. Further, the casing does not need to be shaped as shown. The casing may be of any other shape, so long as it prevents objects from entering into openings "d". In the particular example described above, the casing 200 is made of plastic.

Note further that the casing 200 shown in FIG. 2 may be color-coded to identify one cable from another in a rack system. Specifically, each pair of casings 200 used with a cable (i.e., one for each of the two connectors of the cable) in a rack system may have the same color. This then may enable a user to quickly identify one cable from another.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A device for retrofitting an existing modular connector having a connector tab susceptible to sngagging on objects comprising:

a hollow interior;

a bottom side, the bottom side having a mechanism for attaching and detaching the device to the modular connector, the mechanism being two protrusions, the two protrusions being mated to a cavity in the modular connector thereby locking the device onto the modular connector;

two lateral sides; and the device being color-coded allowing a cable to which the modular connector is connected to be easily identified from a plurality of other cables;

a top side, the top side having i) a device tab, the device tab being a flexible tab capable of being fully depressed for depressing the connector tab when fully depressed, for preventing the connector tab from snagging, and ii) a recess for allowing the connector tab to be fully depressed when the modular connector is being unlatched from a mating connector.

* * * * *